US005735217A

United States Patent [19]

Halbig et al.

[11] Patent Number: 5,735,217

[45] Date of Patent: Apr. 7, 1998

[54] RAIL-TYPE CONVEYOR SYSTEM

[75] Inventors: Helmut Halbig, Oberschleissheim; Werner Gstöttmayer, Eichenau, both of Germany

[73] Assignee: Telelift GmbH, Puchheim, Germany

[21] Appl. No.: 633,755

[22] PCT Filed: Nov. 14, 1994

[86] PCT No.: PCT/EP94/03772

§ 371 Date: Apr. 18, 1996

§ 102(e) Date: Apr. 18, 1996

[87] PCT Pub. No.: WO95/14599

PCT Pub. Date: Jun. 1, 1995

[30] Foreign Application Priority Data

Nov. 24, 1993 [CH] Switzerland ..... 3507/93

[51] Int. Cl.[6] ..... B61B 13/00

[52] U.S. Cl. ..... 105/239; 105/274; 414/359

[58] Field of Search ..... 105/239, 241.2, 105/258, 276, 277, 279, 278, 241.1, 244, 255, 260, 261.1, 264, 269, 270, 274; 414/599, 357, 359, 362, 371

[56] References Cited

U.S. PATENT DOCUMENTS

| | | | |
|---|---|---|---|
| 615,554 | 12/1898 | Hogan | 414/359 |
| 1,301,208 | 4/1919 | Wood | 424/359 |
| 1,426,027 | 8/1922 | Wood | 414/359 |
| 1,706,985 | 3/1929 | Ramsay | 414/359 |
| 2,826,315 | 3/1958 | Fujishige | 414/359 |
| 2,953,408 | 9/1960 | Koenig | 105/276 |
| 3,583,334 | 6/1971 | Schuller | 414/359 |
| 4,974,520 | 12/1990 | Dehne . | |
| 5,488,911 | 2/1996 | Riggin | 105/258 |

FOREIGN PATENT DOCUMENTS

| | | | |
|---|---|---|---|
| 0 513 460 A1 | 11/1992 | European Pat. Off. . | |
| 1279381 | 11/1961 | France | 105/241.2 |
| 810 978 | 8/1951 | Germany . | |
| 24 47 294 | 4/1976 | Germany . | |
| 35054 | 5/1951 | Poland | 414/359 |
| 496 603 | 11/1970 | Switzerland . | |

*Primary Examiner*—Mark T. Le
*Attorney, Agent, or Firm*—Herbert Dubno; Yuri Kateshov

[57] ABSTRACT

The rail-type conveyor system contains self propelling container trucks which circulate between stations and are provided with unlockable unloading device. Each of the stations is termed with at least one stopping point and have a receiving device for accepting the material conveyed. Each stopping point contains a section of rail corresponding to the length of the container truck, with rail parts which engage laterally in a C-shape around the tracks wheels of the container truck. The rail section is mounted so as to be pivotable about a pivot axis in order to unload the container truck on one longitudinal side and is pivotable towards the unloading side.

14 Claims, 8 Drawing Sheets

RAIL-TYPE CONVEYOR SYSTEM

SPECIFICATION

CROSS REFERENCE TO RELATED APPLICATIONS

This application is a National Phase application of PCT/EP94/03772 filed 14 Nov. 1994 and based upon German application CH-3507/93-0 filed 24 Nov. 1993 under the International Convention.

1. Field of the Invention

The invention relates to a rail-type conveyor system.

2. Background of the Invention

Rail-type conveyor systems have been known from Swiss patent 496 603. This conveyor system contains transmitting and receiving stations, in which the conveyor trucks are manually loaded at the transmitting stations, provided with a destination code and despatched. At the receiving station the conveyor trucks again have to be unloaded manually and either reloaded or despatched empty to a collecting station. Thus, an operator is always necessary for loading and unloading and if no such person is available the conveyor truck has to wait at the station and is unavailable for further use. However, waiting conveyor trucks may also block the station by indicating that they are occupied and thus preventing further conveyor trucks from entering.

From German patent 24 47 294 a similar conveyor system for documents is known which overcomes the disadvantages described above by having loading means arranged above the stations for placing material in the conveyor trucks. For unloading, the containers of the conveyor trucks are fitted with floor-mounted flaps which, on opening, deliver the material into receptacles provided at the stations. However, a disadvantage of this is that the containers cannot be mounted above the drive mechanisms of the conveyor trucks but have to be positioned to one side so that the floor-mounted flap is unobstructed. This results in a complicated construction which leads to an asymmetric and therefore unfavourable distribution of forces owing to the one sided arrangement of the container on the chassis and requires a wide-gauge track.

OBJECT OF THE INVENTION

The goal of the invention is to improve a rail-type conveyor system of the kind described hereinbefore so as to avoid the disadvantages outlined above.

SUMMARY OF THE INVENTION

This aim is achieved by providing a rail-type conveyor system having despatching and receiving stations and with self propelling container trucks. The container trucks have unlockable loading and/or unloading means and the despatching and/or receiving stations have at least one stopping point with delivery and/or receiving means for automatic loading and/or unloading. Each stopping point of the receiving station has a rail section corresponding substantially to the length of the container truck with rail portions which engage with a C-shape around the side of the track wheels of the container truck. The rail section is pivotably mounted on a longitudinal side, towards the unloading side, about a pivot axis so that the unloading means can be opened towards receiving means.

By the pivoting of the rail section and hence of the container truck located thereon, this truck is brought into an inclined position which causes it to empty its load. As a result, the container truck can be mounted directly over the truck in the usual way, thereby bringing about the known symmetrical construction which ensures a uniform distribution of forces. This simplifies the structure. In particular, this allows a narrow construction, so that the space taken up by the track can be kept to a minimum.

There are numerous possible methods of initiating the pivoting movement. For instance, the pivoting movement is initiated by the drive of the truck itself, which means that no additional drive is required. Another method of pivoting the rail section is to provide the station with an additional electric drive motor. One particularly simple solution is the container truck which is in motion can drive the pivoting apparatus.

The lifting member necessary for raising or pivoting the rail section may also take various forms such as a cam or a rack or a pivot lever.

The unloading means of the container trucks may take a very wide variety of forms such as a side wall section which can be swung out or a container which can be swung out. These inward and outward swinging movements are effected by pivoting the rail section up at the stopping point of the receiving station.

For controlling the loading and unloading operations at the despatching and/or receiving stations and at the container trucks, there are numerous different constructions, ranging from purely mechanical switching members through electro-optical switching means to software control of the truck. Such switching means are present in large numbers in the existing rail type conveyor systems of the known kind and can readily be adopted for the present purposes.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
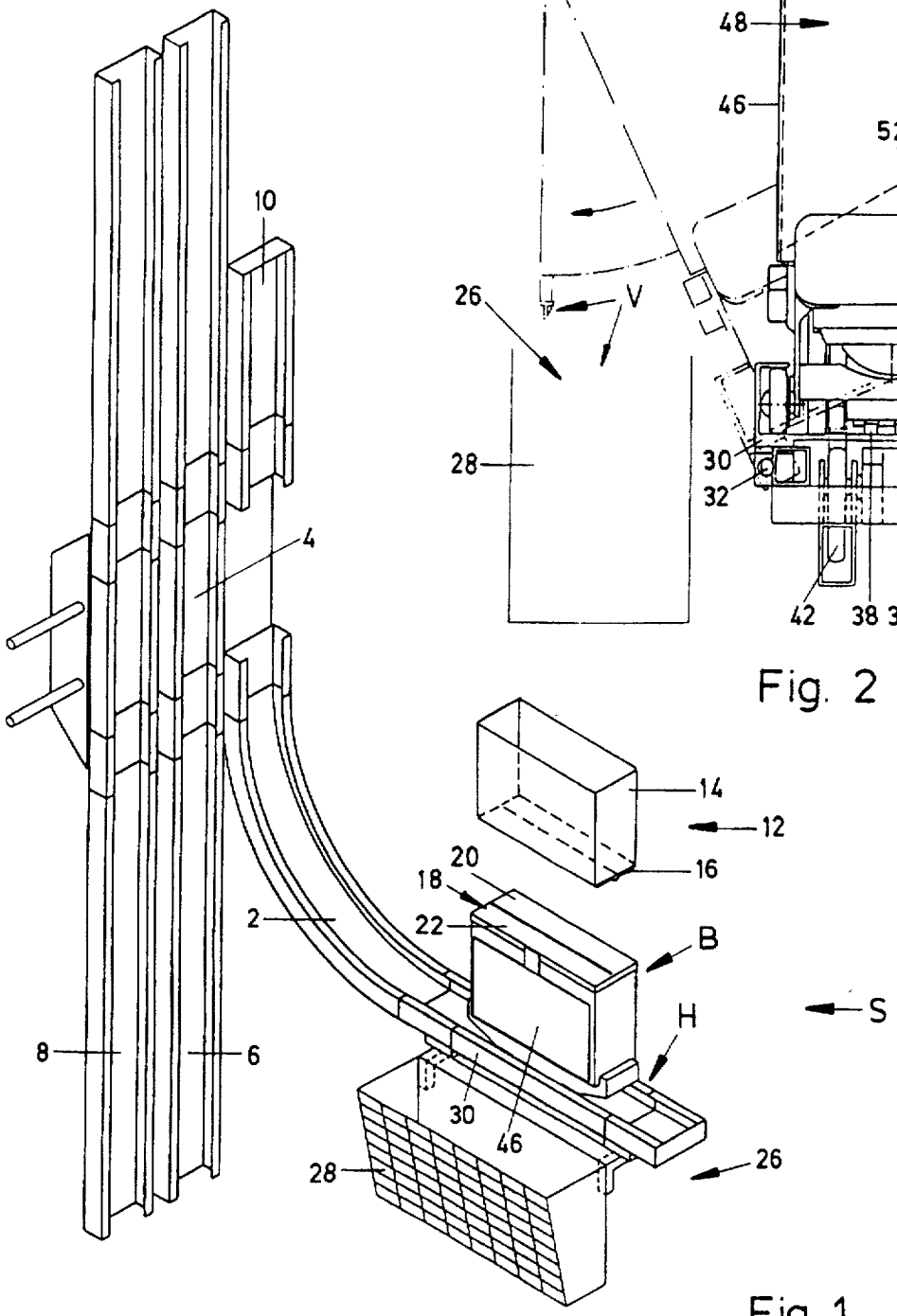
FIG. 1 is a schematic view of a despatching and receiving station, designed for loading and unloading, in the form of a simple reverse entry station, shown diagrammatically.

FIG. 1 shows a station S constructed as a reverse entry station according to Swiss patent 496 603, the rail track 2 of which is connected to vertical tracks 6, 8 via a switch point 4. In addition, another rail section 10 may be provided as a storage area, associated with the track 2 on the opposite side of the switch point 4. In the example illustrated, the station S has only one stopping point H for a container truck B and is intended for both loading and unloading. The station could also have two or more stopping points. The station contains delivery means 12 which comprise a delivery magazine 14 having a base 16 which opens downwards. The latter is located opposite an openable lid 18 of the container truck B. The lid is constructed in sections in the longitudinal direction, the lid sections 20, 22 being inwardly pivotable and biased in the closed position against stops 24, by means of a spring (not shown), as illustrated in FIG. 2.

However, the station is also constructed as a receiving station and contains corresponding receiving means 26 which, as shown, may be arranged underneath the delivery means 12 or behind the delivery means. These receiving means contain a catching basket 28 which may be fitted with a fullness indicator (not shown in detail), eg. a light beam, for monitoring the level of fullness. Furthermore, the receiving means 26 contain a rail section 30 which is pivotably mounted about a pivot axis 32 on the unloading side. The rail section 30 contains two current-carrying rails 34, 36 in known manner and a control rail 38 for controlling the container truck B. This control rail 38 may simultaneously serve to control a drive 40 (FIG. 2) for the stopping point H, the motor 41 of which is coupled via gears to a lifting member 42 (FIGS. 1 and 2) which serves to swing up the rail section 30. In the example shown in FIG. 5, the lifting member takes the form of a control cam which cooperates with the underside 44 of the rail section 30. In the swung-out position, the container truck cooperates with a switching member (eg. analogously to the switching member 82 in FIG. 7) which releases a locking mechanism V (FIG. 2), which in turn releases a pivotable side wall 46 (FIGS. 1 and 2) which is hinged to the upper part of the container 48 by means of a hinge 50. Once the side wall 46 is open, the material being conveyed can slide out of the container 48 into the catching basket 28. The emptying movement is assisted by a base 52 (FIG. 2) in the container which slopes down towards the unloading side. After the container 48 has been emptied, the drive 40 is switched on by means (not shown in detail) in order to swing the rail section 30 back into its original position. At the same time the side wall 46 is closed and locked by means of the locking mechanism V. The container is now ready for other tasks and may, for example, pick up new material from the delivery means or the destination code may be automatically switched over to a collecting station, in a manner not shown in detail, so that the container truck B is authorised to leave the station automatically and proceed to the collecting station.

Figure 2:
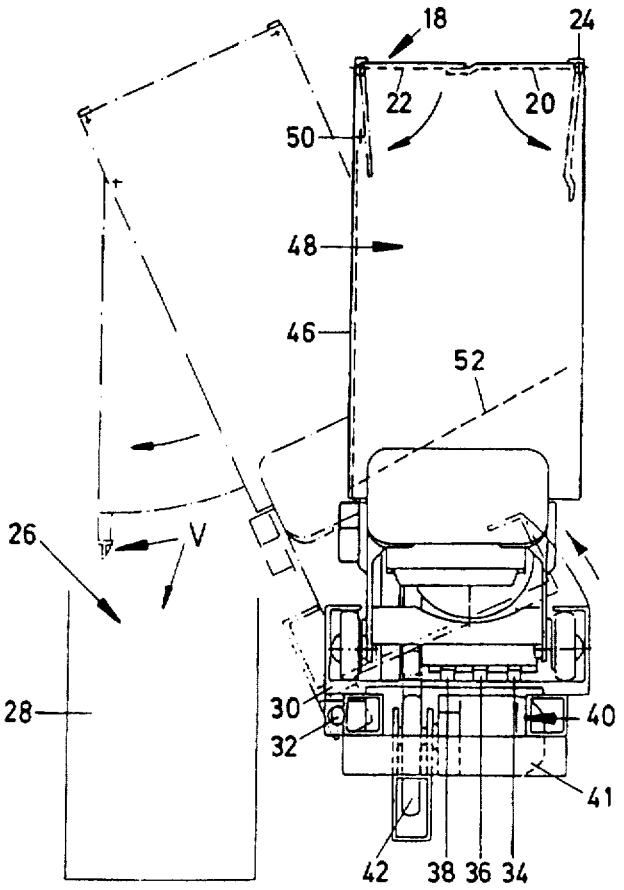
FIG. 2 is a diagrammatic view of a container truck at the despatching/receiving station in FIG. 1 viewed at right angles to the direction of the rails.
Figure 5:
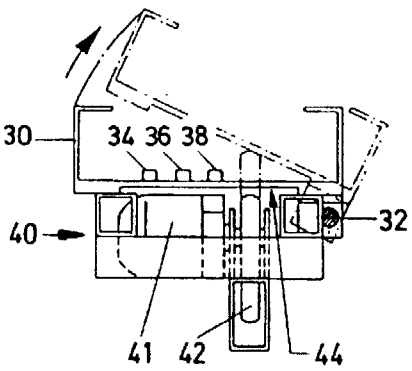
FIG. 5 is a cross sectional view of the stopping point in the station in FIG. 1.
Figure 3:
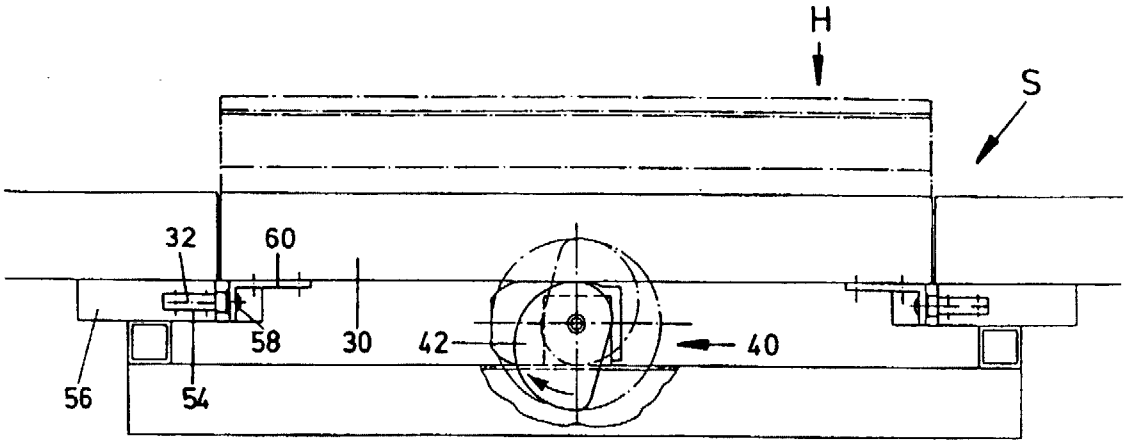
FIG. 3 is the stopping point of the station in FIG. 1 viewed from the unloading side.
Figure 4:
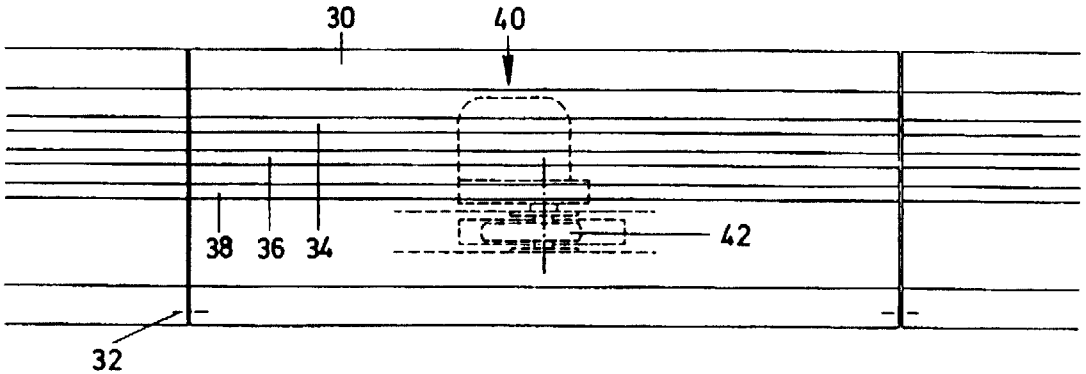
FIG. 4 is a plain view of the stopping point of the station in FIG. 1.

FIGS. 3 to 5 again show details of the stopping point H of the station S in FIGS. 1 and 2. The pivot axis 32 formed by bolts 54 is visible. The bolts 54 are fixed in the chassis 56 and engage in openings 58 in angle irons 60 to which the rail section 30 is fixed. FIGS. 3 to 5 also show the drive 40 attached to the chassis 56 with the lifting member 42, constructed as a cam, which cooperates with the underside 44 of the rail section 30.

Figure 6:
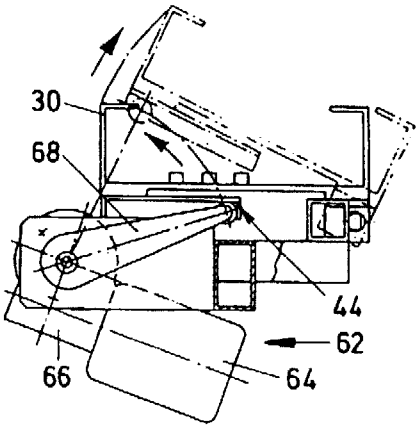
FIG. 6 is a cross sectional view of the stopping station with a modified drive.

FIG. 6 shows another embodiment of a drive 62 which is fixed to the chassis 56. This drive contains a motor 64 with gearing 66 which is coupled to a lifting member 68 which is in the form of an oscillating lever and cooperates with the underside 44 of the rail section 30.

Figure 7:
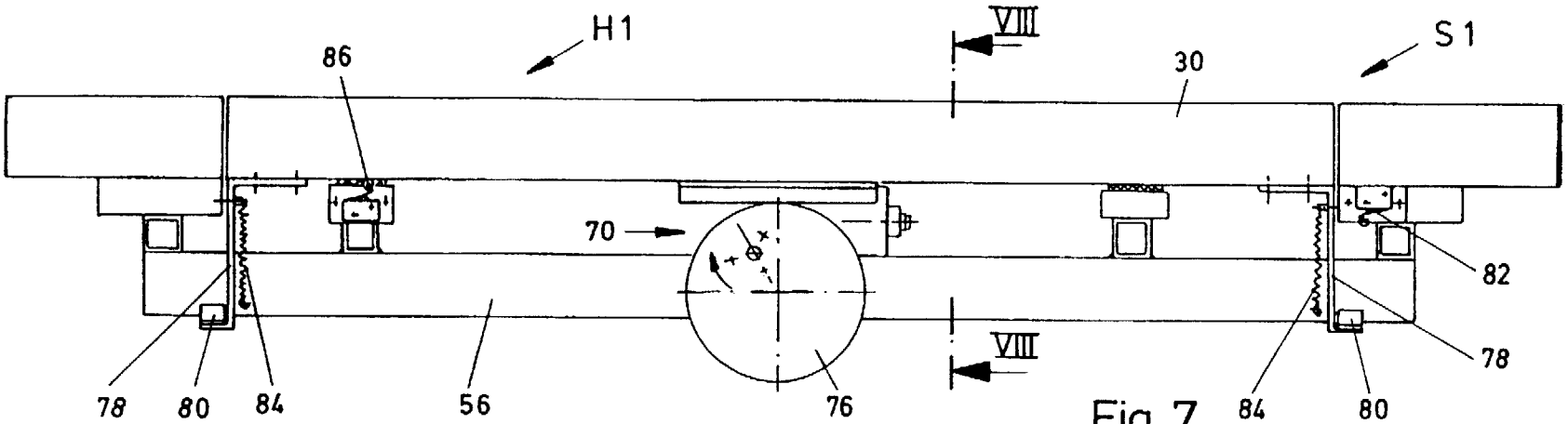
FIG. 7 is a diagrammatic view of the stopping station with the switching means viewed on the longitudinal side remote from the unloading side.
Figure 8:
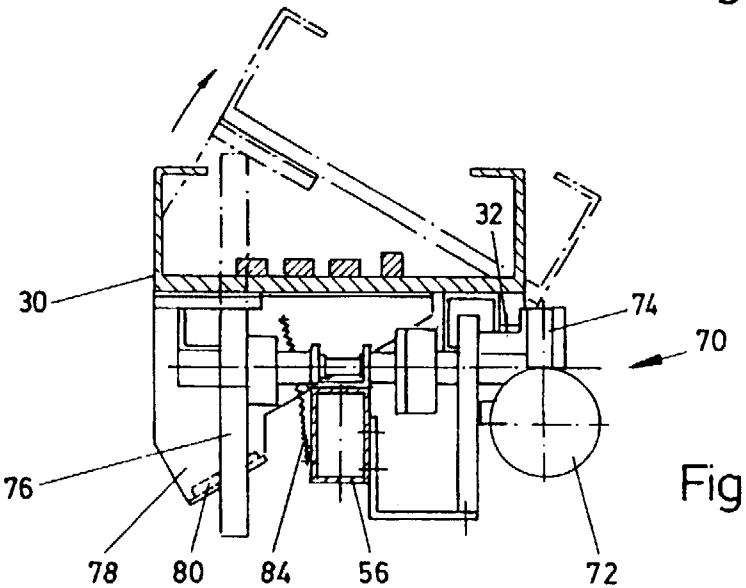
FIG. 8 is a sectional view of the stopping point along VIII—VIII of FIG. 7.
Figure 9:
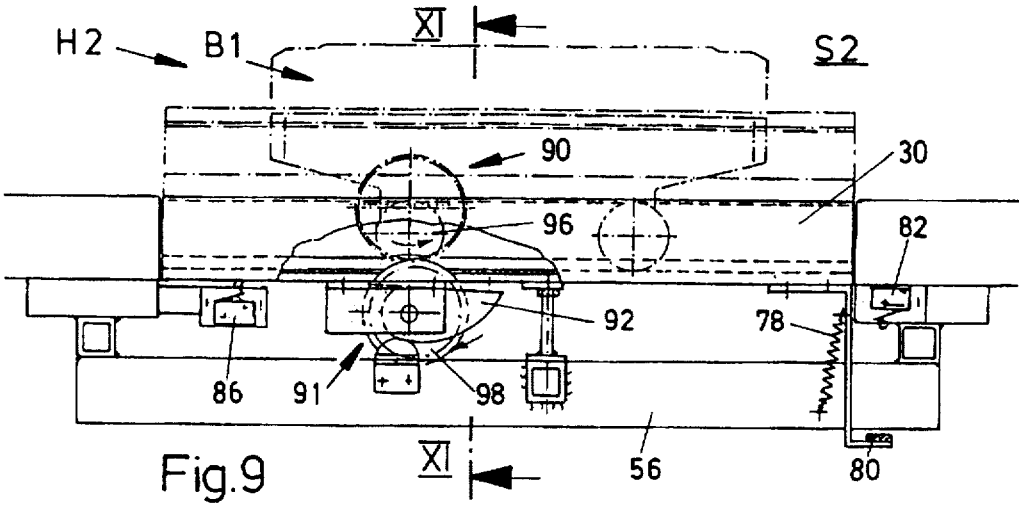
FIG. 9 is a partial sectional view of another stopping point view along the longitudinal side remote from the unloading side.
Figure 10:
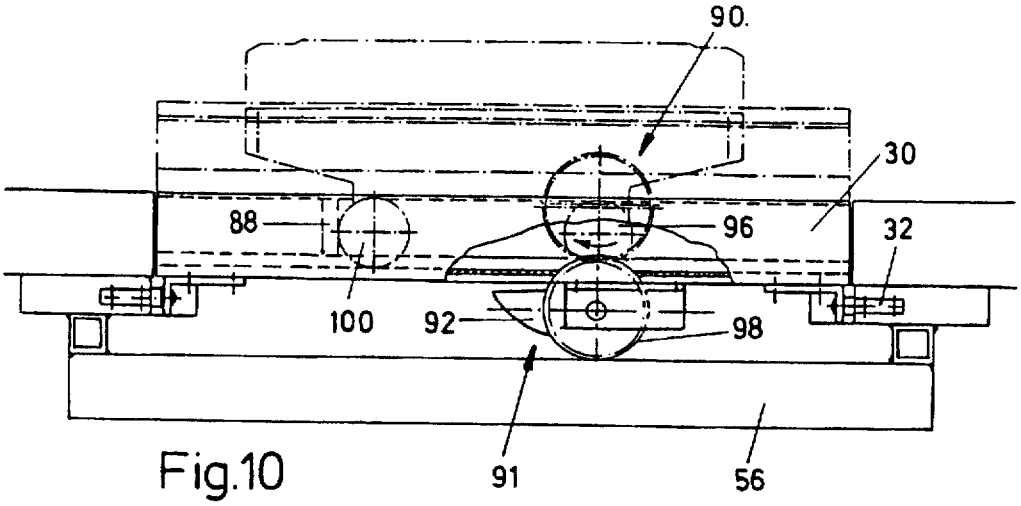
FIG. 10 is the stopping point in FIG. 9 viewed on the unloading side.
Figure 11:
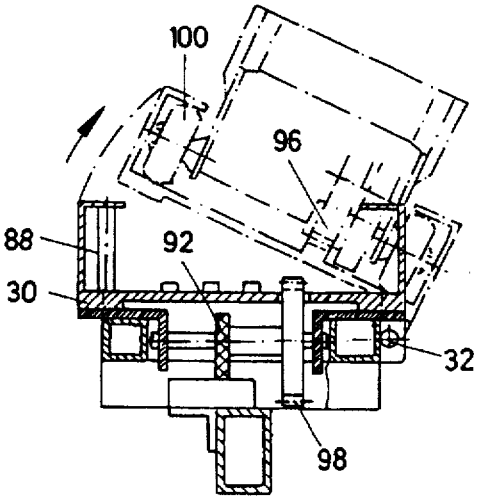
FIG. 11 is a sectional view of the stopping point in FIG. 9 along XI—XI.
Figure 12:
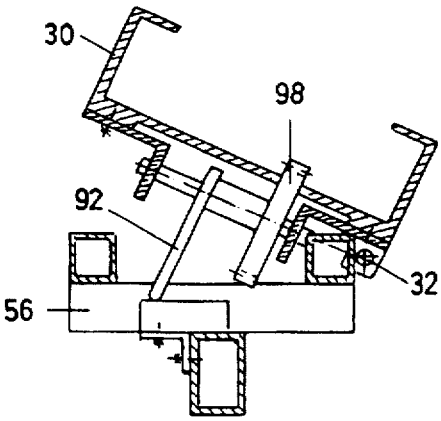
FIG. 12 is the stopping point of FIG. 11 with the rail section tilted upwards.

FIGS. 7 and 8 show another embodiment of the stopping point H1 of a station S1 and, in particular, control means for controlling the pivoting movement. The drive 70 connected to the chassis 56 contains a motor 72 which is coupled via gearing 74 to a lifting member 76 which is in turn constructed as a cam. Instead of the cam, the drive might also contain a pinion gear cooperating with a rack which might cooperate with the underside of the rail section 30. Fixed to the rail section 30, on the side remote from the pivot axis 32, are angle profiles 78 which at their free ends form abutments 80 which limit the pivoting movement of the rail section. In the swung-out position, the abutment 80 interacts with a switching member 82 which unlocks the locking mechanism and temporarily interrupts the drive 70 until a container of the container trucks has been emptied. Then the drive 70 is switched on again and the rail section 30 returns to its original position under the force of the tension springs 84 arranged between the angle profile 78 and the chassis 56. Here, the rail section 30 cooperates with a switching member 86 which switches off the drive 70 and initiates the other functions which have already been described hereinbefore.

FIGS. 9 to 12 show another stopping point H2 of a station S2, which is preferably constructed as an end station, so that a container truck B1 can travel up to a fixed stop 88. In this way it is possible for the drive 90 of the container truck B1 to serve simultaneously as the drive 91 of a lifting member 92 for pivoting the rail section 30 about the pivot axis 32. For this purpose, a gear wheel 96 which is connected to the drive 90 and cooperates with a rack on the rail in certain sections of the track, meshes with a gear wheel 98 coupled to the lifting member 92, at the stopping point H2. If a container truck B1 now enters the stopping point H2, it abuts a track wheel 100 on the abutment 88 which is arranged so that the gear wheels 96 and 98 engage. When the drive 90 is switched on the gear wheel 96 actuates the gear wheel 98 of the rail section 30 and pivots the lifting member 92 until the rail section 30 is swung out and the abutment 80 makes contact with the control member 82. The control member 82 may additionally serve to interrupt the drive 90 and also initiate the functions described above. By reversing the direction of rotation of the drive 90, the lifting member 92 may be swung back into the original position and the rail section 30 will therefore also resume its original position in which the control member 86 is actuated, which can initiate the functions described above.

Figure 14:
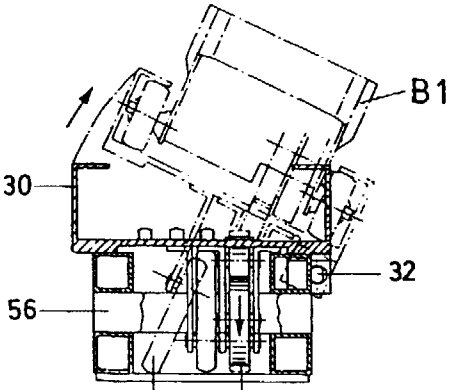
FIG. 14 is a sectional view of the stopping point of FIG. 13 along the line XIV—XIV.
Figure 13:
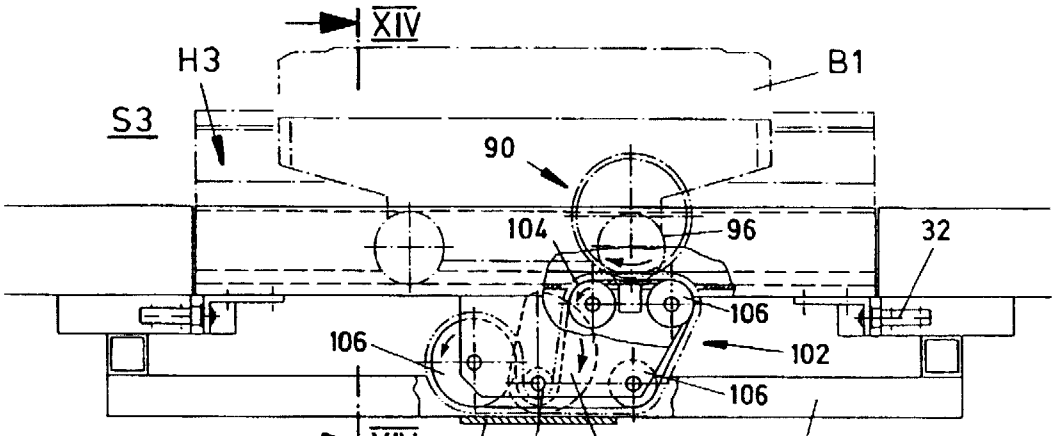
FIG. 13 is a partial sectional view of still another stopping point viewed along the unloading side.

FIGS. 13 and 14 show another embodiment of the drive 102 of a stopping place H3 and a station S3 which is constructed analogously to the drive 91 of the stopping point H2 of the station S2 in FIGS. 9 to 12, except that the gear wheel 96 of the drive 90 of the container truck B1 interacts not with a gear wheel 98 but with a toothed belt 104 which is guided over various guide rollers 106 and cooperates with gear wheel 108 coupled to the lifting member 110. The lifting member 110 is in turn constructed as a cam and cooperates with a support plate 112 of the chassis 56.

Figure 16:
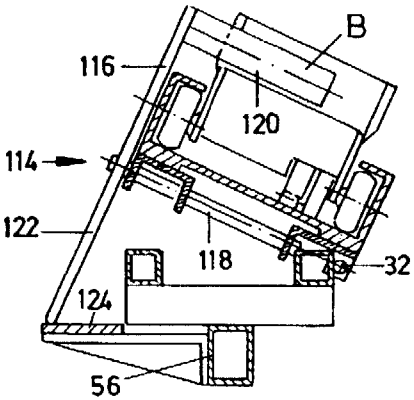
FIG. 16 is a sectional view of the stopping point of FIG. 15 along XVI—XVI with the rail section tilted upwards.
Figure 15:
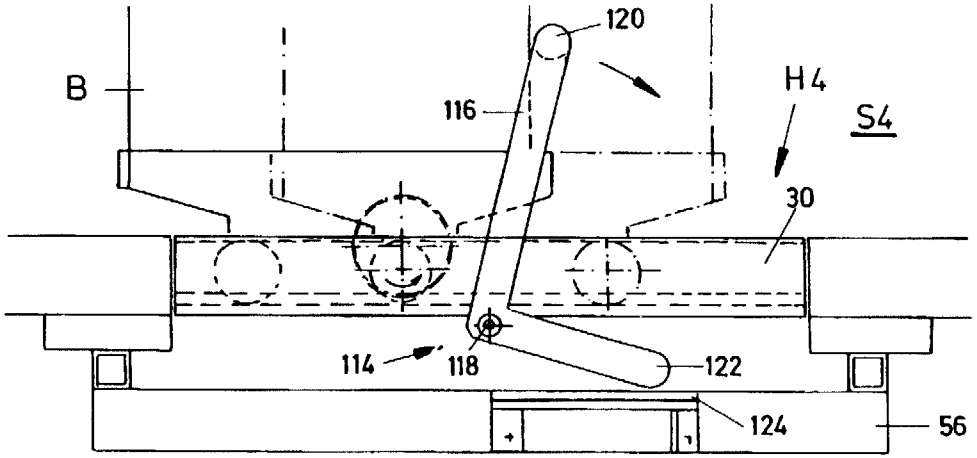
FIG. 15 is yet another stopping point viewed on the side remote from the unloading side.

FIGS. 15 and 16 show another particularly simple embodiment of a stopping point H4 at a receiving station S4. The drive 114 for pivoting the rail section 30 comprises a lever 116 rotatably mounted on a spindle 118 on the pivotable rail section 30. The lever 116 has, at its upper end, an arm 120 which projects into the path of travel of the container truck B and is actuated by said truck. The lever is constructed as an angle lever, the second lever acting as a lifting member 122 which cooperates with a support plate 124 on the chassis 56. As can be seen in FIG. 15, the lever 116 is flipped over by an incoming container truck B, whereupon the lifting member 122 pivots the rail section 30, as shown in FIG. 16. After the unloading operation has ended, reversal of the direction of travel of the container truck allows the lever 116 to return to its original position and thereby swing the rail section 30 back.

Figure 17:
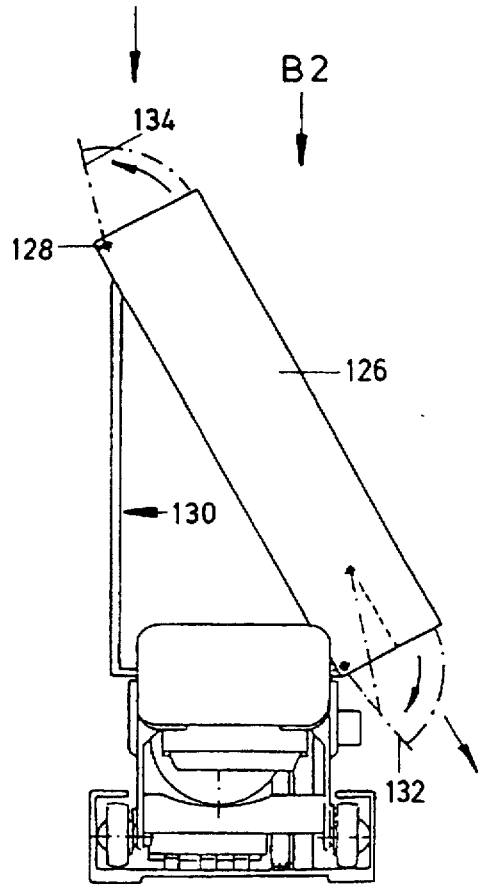
FIG. 17 is another container truck with a container which can be swung out, viewed at right angles to the direction of travel.

FIG. 17 shows another container truck B2 having a container 126 which is pivotably attached to a chassis 130, about a longitudinal axis 128, at its upper end on the side remote from the unloading side. As a result of the pivoting of the rail section (not shown in detail) at a receiving station in the manner described above, the container 126 swings out onto the unloading side, as shown in FIG. 17. During this movement or after the swung-out position has been reached, the base 132 is released and flips out, as indicated by broken lines in FIG. 17. After emptying, the base 132 is closed again, by the pivoting back of the container 126, and locked. Since the base 132 is located opposite the chassis 130, the base 132 is also prevented from opening accidentally once the container 126 has been swung in. Mounted on the upper end of the container 126 is a lid 134 which can be unlocked at a despatching station to allow the container to be loaded.

Figure 18:
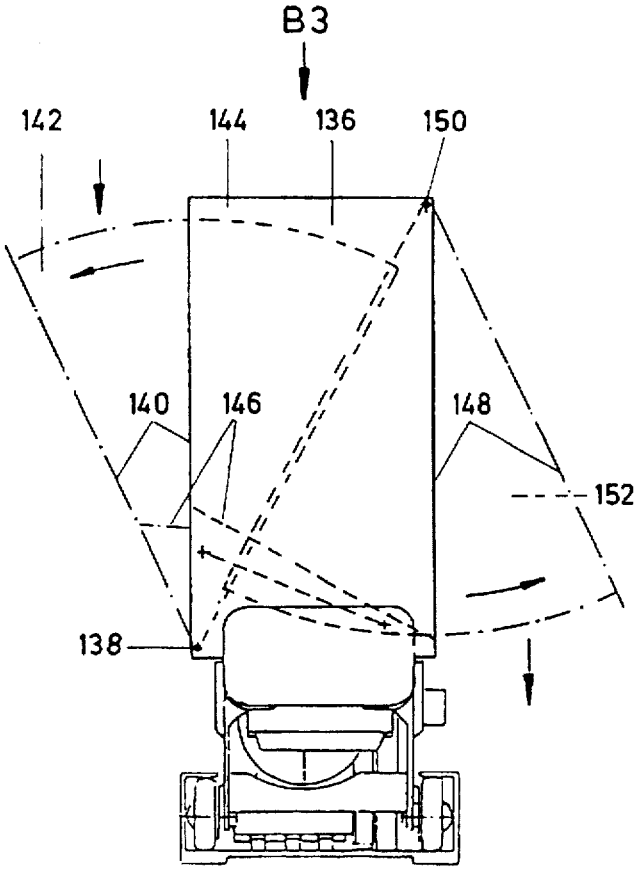
FIG. 18 is another conveyor truck with fold-out wall portions for loading and unloading viewed at right angles to the direction of conveying.

FIG. 18 shows another container truck B3 the container 136 of which has, along one longitudinal side, a side wall 140 which is pivotable about a lower axis 138, this side wall 140 being furthermore provided with side wall sections 142 along its sides which partly cover the end walls 144. For loading, the side wall 140 is tilted outwards (as shown by broken lines) and thus forms a lateral opening in the upper part to enable the container to be loaded. Moreover, a base 146 is fixed to the side wall 140 and is inclined towards the unloading side when the side wall 140 is closed. On the unloading side, the side wall 148 is pivotably fixed about an upper axis 150 and is also provided with side walls portions 152 which in turn interact with the end walls 144. For unloading, the side wall 148 is swung out by the pivoting of the rail section at the station (as shown by broken lines) and forms a downward opening for expelling the material being conveyed. Conventional locking means hold the side walls 140, 148 in the closed position during travel.

FIGS. 19 to 22 show various locking mechanism V1, V2, V3, V4 for wall and lid sections of the containers which have to be opened.

Figure 19:
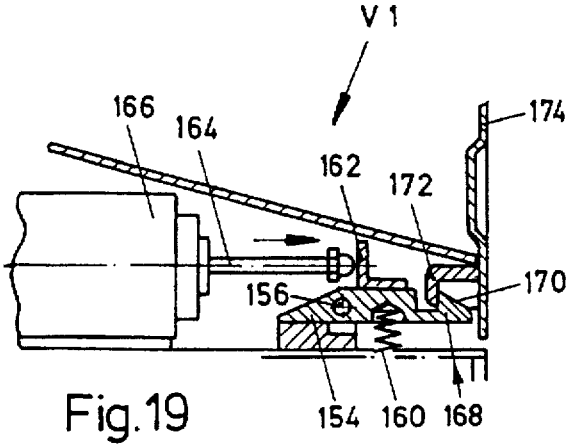

The locking mechanism V1 in FIG. 19 shows a snap-fit member 154 in the form of a simple one-arm lever 158 pivotably mounted about a spindle 156, this lever being biased in the locking position by means of a spring 160. In the locked position the lever 158 abuts, via an attachment 162, on a push rod 164 of an actuating mechanism 166, eg. in the form of an electro magnet. The snap-fit member contains a hook 168 with an lead-in surface 170 and cooperates with a hook 172 arranged on a pivotable wall section 174. By means of the actuating mechanism 166 the snap-fit member 154 is swung into the release position and releases the hook 172 and hence the wall section 174.

Figure 20:
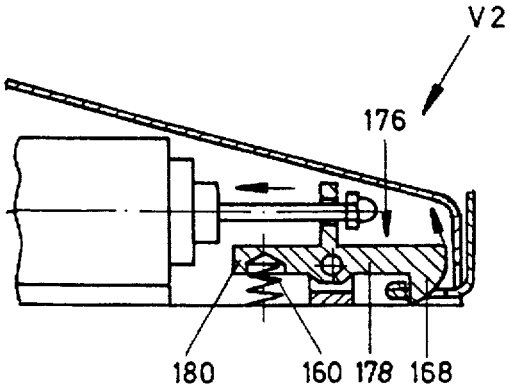

The locking mechanism V2 in FIG. 20 corresponds to the one shown in FIG. 19, the snap-fit member 176 being constructed a two-armed lever, the hook 168 being formed on one arm 178 thereof whilst the spring 160 engages on the other arm 180 thereof.

Figure 21:
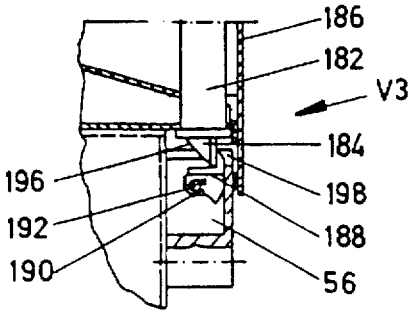

FIG. 21 shows another locking mechanism V3 in which a catch 184 is fixed to a pivotable wall section 186 by means of an actuating mechanism 182, for example an electromagnet. In the locked position, the catch 184 abuts on a retaining member 188 which is hinged to the chassis 56 so as to be pivotable about an axis 192 under the effect of a biasing spring 190. The catch 184 and the retaining member 188 have lead-in surfaces 196 and 198 which allow the catch 184 to snap automatically onto the retaining member 188.

Figure 22:
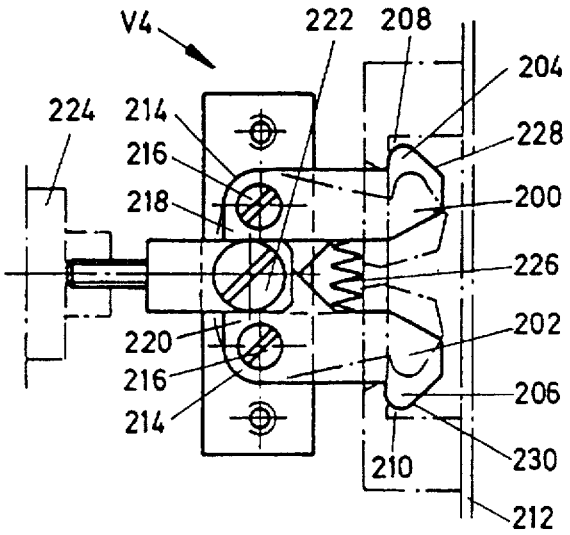
FIGS. 19 to 22 are different locking devices for securing parts of the container which can be opened.

FIG. 22 shows another locking mechanism V4 having two snap-fit members 200, 202 which engage, with their latches 204, 206 facing away from each other, in latching recesses 208, 210 which face towards one another and are provided for example on a pivotable wall section 212. The snap-fit members 200, 202 are constructed as angled levers the bent sections 214 of which are pivotably mounted on bolts 216. The snap-fit members each have an arm 218, 220 facing towards one another, which are hinged together by means of a bolt 222, whilst an actuating mechanism 224 acts on this bolt. A biasing spring 226 biases the snap-fit members 200, 202 outwards and secures the engagement of the latches 204, 206 in the latch recesses 208, 210. Provided on the latches 204, 206 and latch recesses 208, 210 are lead-in surfaces 228, 230 which ensure automatic latching.

Figure 23:
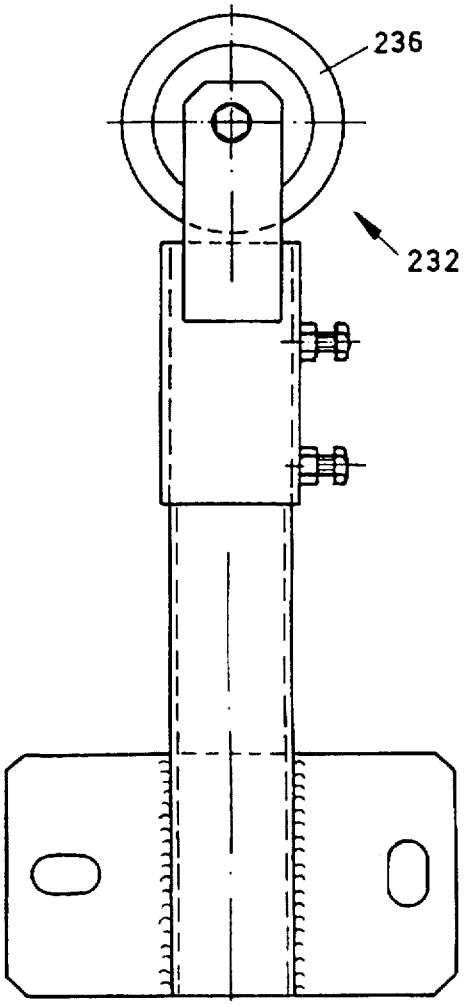
FIG. 23 is a pressing roller, to be arranged in the path of travel of the container, in order to assist the locking operation.

FIG. 23 shows a securing device 232, to be provided at the exit from a station, which has a foam roller 236 rotatably mounted on a spindle 234. This securing device 232 is provided alongside the track for the container trucks in such a way as to cooperate with that part of the container which can be swung out for loading and unloading. The foam roller 236 is positioned so that it presses the pivotable part into the locked position as the container truck travels past, to ensure that the locked position is maintained in practice.

Figure 24:
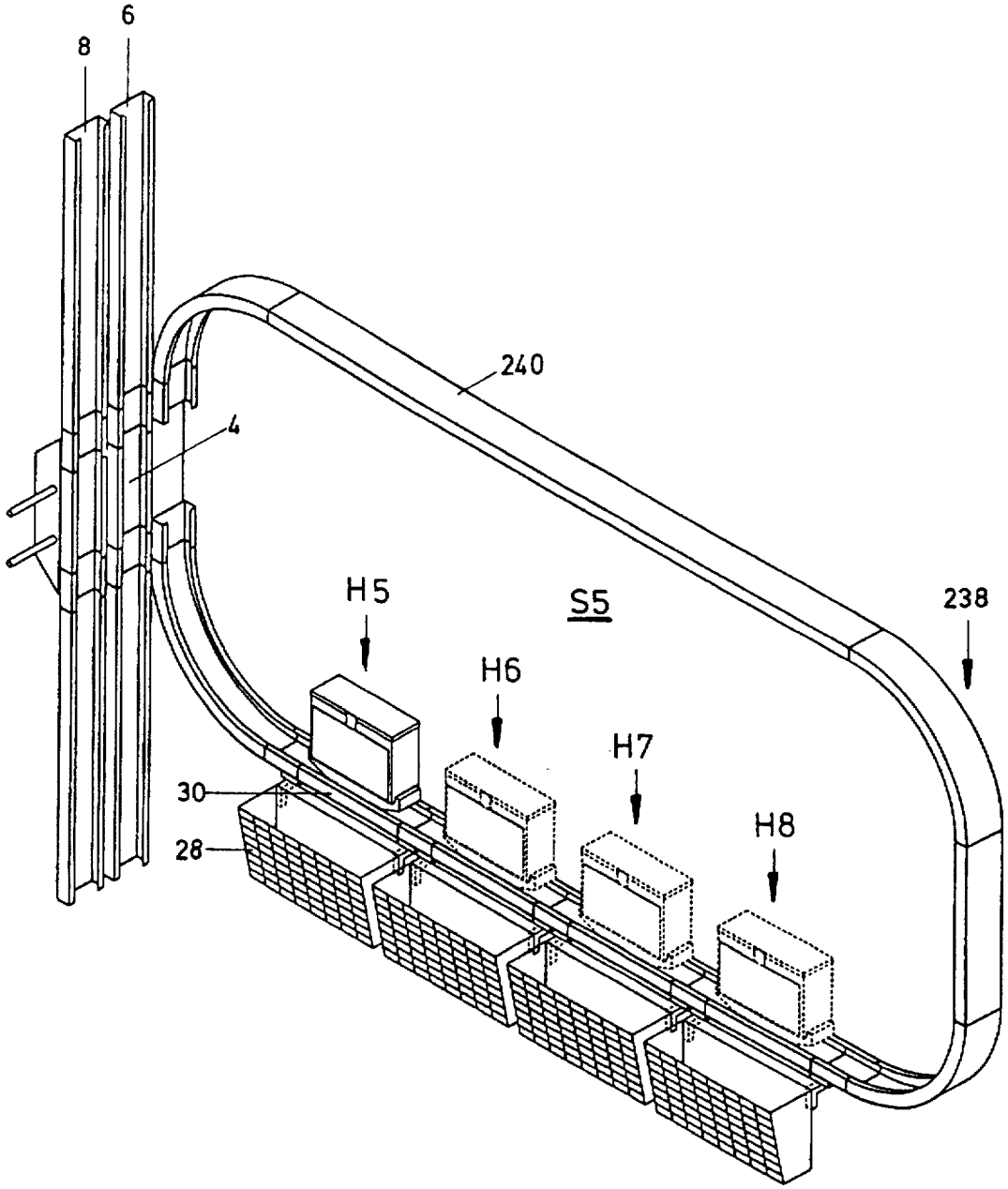
FIG. 24 is a diagrammatic view of a receiving station, constructed as a through-station.

FIG. 24 shows a receiving station constructed as a through-station S5, having a rail loop 238 connected to the tracks 6, 8 via a switch point 4. The station may have one or more stopping points; in the present instance there are four stopping points H6, H6, H7, H8, each of which has an associated pivotable rail section 30 and a catching basket 28. Since the individual stopping points are not constructed as end stations, drives as shown in FIGS. 3 to 8 are preferred for driving the pivotable rail section 30. After unloading, the container trucks can leave the stopping point and, if required, be stored in the upper section 240 of the rail loop 238 until the switch point 4 is switched over for continued travel. The rail section 240 may, however, be travelled over in the opposite direction and act as a holding depot for incoming container trucks until a stopping point is free. The through-station may also be provided with one or more delivery means analogous to station H in FIG. 1, in a manner not shown here, these delivery means being arranged above or offset from the stopping points H5, H6, H7, H8. The container trucks temporarily stored in the upper rail section 240 can then be taken first to delivery means for loading before being despatched into the network or called away.

The loading and/or unloading operation at the despatching and/or receiving stations and on the container trucks may be controlled in numerous ways which are known per se, ranging from the simplest mechanical switching elements through electrical switching elements to fully automated programme control. Such control means are well known for other applications in rail-type conveyor systems of the type in question and can readily be adopted for the present invention.

Since the container trucks are automatically loaded and/or unloaded at the despatching and/or receiving stations, the empty conveyor trucks can be returned directly into the conveyor system, either being sent to a collecting point where they wait for further instructions or being sent directly to another station to perform a task. A conveyor system constructed in this way is substantially more efficient, since the conveyor trucks finish their job much faster and are immediately available for further tasks, so that the same capacity can be achieved as with known conveyor systems but using fewer container trucks. Moreover, the individual stations are no longer blocked by waiting container trucks, which means that the economy and flexibility of the system is improved substantially. By this automation it is possible to save up to 50% of the container trucks hitherto required, depending on the construction of the particular conveyor system.

We claim:

1. A rail-type conveyor system comprising:

a plurality of self-propelling identical trucks guided along a longitudinal travel path, each of said trucks being provided with a respective plurality of wheels and a respective lock means for controllably opening and locking the truck;

at least one dispatching station along said path formed with at least one loading station receiving each of the trucks upon stopping thereof, said one loading station being provided with:

a respective C-shape rail pivotally mounted on a longitudinal side thereof and extending along a longitudinal axis and formed with a pair of opposite longitudinal sides extending at least at a length corresponding to a length of the truck and engaging the wheels of the truck, a respective lift means including a respective drive actuatable by the truck and a lifting member for pivoting the rail between horizontal and inclined positions of the rail, a respective delivery means for loading the truck with a load in the horizontal position of the rail, and a respective unloading means mounted on a one side of the respective rail and extending laterally off the rail for receiving the load from the truck opened by the respective locking means upon pivoting of said rail in the inclined position.

2. The conveyor system defined in claim 1 wherein each of the trucks having a respective drive gear wheel, the lift means further including a respective gear wheel meshing with the gear wheel of the truck for actuating said lifting member.

3. The conveyor system defined in claim 2 wherein said lift means further comprising a respective toothed belt coupled with said lifting member.

4. The conveyor system defined in claim 1 wherein said drive of the lift means has a stationary electric motor.

5. The conveyor system defined in claim 1 wherein said lift means further includes an actuating lever projecting along said travel path and coupling with the lifting member.

6. The conveyor system defined in claim 1 wherein the lifting member is a cam mounted on a chassis of the conveying system and cooperating with a bottom of said rail.

7. The conveyor means defined in claim 2 wherein said rail is formed with a rack.

8. The conveyor system defined in claim 1 wherein said lifting member is a pivot lever actuated to contact with said rail for pivoting the latter.

9. The conveyor system defined in claim 1 wherein each of said self-propelling trucks is formed with a respective side wall pivotally mounted on a respective upper wall of the truck, the respective lock means being operatively connected with a respective base of the truck, so that the side wall is controllably swung open in a position corresponding to the inclined position of the rail.

10. The conveyor system defined in claim 1 wherein the dispatching station includes another loading station.

11. The conveyor system defined in claim 1 wherein the dispatching station is a reverse entry station.

12. The conveyor system defined in claim 1 wherein the dispatching station is a loop, the loading station being formed on a lower part of the loop, an upper part of the loop being adapted to be a storing station for the self-propelling trucks before or after loading or unloading thereof.

13. The conveyor defined in claim 1 wherein the loading station further includes retractable abutting means for stopping the self-propelling truck on the loading station.

14. A rail-type conveyor system comprising:

a plurality of self-propelling identical trucks guided along a longitudinal travel path, each of said trucks being provided with a respective plurality of wheels and a respective lock means for controllably opening and locking the truck;

at least one dispatching station along said path formed with at least one loading station receiving each of the trucks upon stopping thereof, said one loading station being provided with:

a respective C-shape rail extending along a longitudinal axis and formed with a pair of opposite longitudinal sides extending at a length corresponding to a length of the truck and engaging the wheels of the truck, the rail being pivotal about a respective longitudinal axis extending generally along one of the opposite sides between a loading horizontal and unloading inclined positions of the rail, a respective lift means for pivoting the rail between respective horizontal and inclined positions of the rail, a respective delivery means for loading the truck with a load in the horizontal position of the rail, and a respective unloading means mounted on the one side of the respective rail and extending laterally off the rail for receiving the load from the truck opened by the respective locking means upon pivoting of said rail in the inclined position.

* * * * *